US011374373B2

(12) United States Patent
Chew et al.

(10) Patent No.: US 11,374,373 B2
(45) **Date of Patent: *Jun. 28, 2022**

(54) PRESS-FIT PIN FOR SEMICONDUCTOR PACKAGES AND RELATED METHODS

(71) Applicant: SEMICONDUCTOR COMPONENTS INDUSTRIES, LLC, Phoenix, AZ (US)

(72) Inventors: Chee Hiong Chew, Seremban (MY); Atapol Prajuckamol, Thanyaburi (TH); Yusheng Lin, Phoenix, AZ (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/931,109

(22) Filed: May 13, 2020

(65) Prior Publication Data

US 2020/0274310 A1 Aug. 27, 2020

Related U.S. Application Data

(60) Continuation of application No. 15/392,011, filed on Dec. 28, 2016, now Pat. No. 10,693,270, which is a (Continued)

(51) Int. Cl.
*H01R 12/00* (2006.01)
*H01R 43/16* (2006.01)
(Continued)

(52) U.S. Cl.
CPC ..... *H01R 43/16* (2013.01); *H01R 12/585* (2013.01); *H01R 13/052* (2013.01); *H01R 13/415* (2013.01); *H01R 43/26* (2013.01)

(58) Field of Classification Search
CPC ..... H01R 13/4362; H01R 13/6595; H01R 12/585; H01R 43/0235; H01R 43/0256
(Continued)

(56) References Cited

U.S. PATENT DOCUMENTS 3,444,617 A 5/1969 Stricker et al.
3,539,954 A 11/1970 Camire
(Continued)

FOREIGN PATENT DOCUMENTS

EP 0236186 A1 9/1987

OTHER PUBLICATIONS

"AN-4167 Mounting Guideline for F1/F2 Modules with Press-Fit Pins," published online at least as early as Dec. 4, 2014 by Fairchild Semiconductor Corporation, available online at https://www.fairchildsemi.com/application-notes/AN/AN-4167.pdf , last visited Dec. 4, 2014.

(Continued)

*Primary Examiner* — Phuong K Dinh
(74) *Attorney, Agent, or Firm* — Adam R. Stephenson, Ltd.

(57) ABSTRACT

A press-fit pin for a semiconductor package includes a shaft terminating in a head. A pair of arms extends away from a center of the head. Each arm includes a curved shape and the arms together form an s-shape. A length of the s-shape is longer than the shaft diameter. An outer extremity of each arm includes a contact surface configured to electrically couple to and form a friction fit with a pin receiver. In implementations the press-fit pin has only two surfaces configured to contact an inner sidewall of the pin receiver and is configured to contact the inner sidewall at only two locations. The shaft may be a cylinder. The s-shape formed by the pair of arms is visible from a view facing a top of the press-fit pin along a direction parallel with the longest length
(Continued)

of the shaft. Versions include a through-hole extending through the head.

19 Claims, 7 Drawing Sheets

Related U.S. Application Data division of application No. 14/662,591, filed on Mar. 19, 2015, now Pat. No. 9,570,832.

(51) Int. Cl.
*H01R 13/415* (2006.01)
*H01R 12/58* (2011.01)
*H01R 43/26* (2006.01)
*H01R 13/05* (2006.01)

(58) Field of Classification Search
USPC ..... 439/82, 751
See application file for complete search history.

(56) References Cited

U.S. PATENT DOCUMENTS

| | | | | |
|---|---|---|---|---|
| 4,415,220 | A | 11/1983 | Kant | |
| 4,586,778 | A | 5/1986 | Walter | |
| 4,746,301 | A * | 5/1988 | Key | H01R 12/58 439/751 |
| 4,878,861 | A | 11/1989 | Kendall et al. | |
| 4,997,379 | A * | 3/1991 | Rozmus | H01R 12/585 439/751 |
| 5,094,633 | A | 3/1992 | Arai | |
| 5,893,779 | A | 4/1999 | Bianca et al. | |
| 6,354,849 | B1 * | 3/2002 | Jones | H01R 12/585 439/82 |
| 8,083,554 | B2 | 12/2011 | McAlonis et al. | |
| 9,570,832 | B2 | 2/2017 | Chew et al. | |
| 2008/0207015 | A1 | 8/2008 | Sueyoshi | |
| 2014/0199861 | A1 | 7/2014 | Mattiuzzo | |
| 2017/0110843 | A1 | 4/2017 | Chew et al. | |

OTHER PUBLICATIONS

"Mounting instructions for PressFIT modules with forked pins: EconoPACK/EconoPIM/EconoBRIDGE," published online at least as early as Dec. 4, 2014 by Infineon Technologies AG, available online at http://www.infineon.com/dgdl/Infineon-AN2007_09_Mounting_instruction_for_PressFIT_with_forked_pins-AN-v2.0-en.pdf?fileId=db3a304316f66ee80117a6f35bc64902, last visited Dec. 4, 2014.

"PressFIT Infineon's established, reliable mounting technology," published online at least as early as Dec. 4, 2014 by Infineon Technologies AG, available online at http://www.infineon.com/dgdl?folderId-db3a304412b407950112b408e8c90004&fileId-db3a304335113a6301351ed9f421135e, last visited Dec. 4, 2014.

"Reliability of PressFIT connections," T. Stolze, M. Thoben, M. Koch, and R. Severin, published online at least as early as Dec. 4, 2014 by Infineon Technologies AG, available online at https://www.infineon.com/dgdl/Infineon-PCIM_2008_Reliability_of_PressFIT-ED-v1.0-en.pdf?fileId=db3a30431a5c32f2011a5decala100ad, last visited Dec. 4, 2014.

"Application Note Assembly Instructions for the Easy-PressFIT Modules," published online at least as early as Dec. 4, 2014 by Infineon Technologies AG, available online at http://www.infineon.com/dgdl/Infineon-AN2009_01_Mounting_Instructions_Easy_PressFIT-AN-v2.1-en.pdf?fileId-db3a30431ed1d7b2011ef425e7c75c5c, last visited Dec. 4, 2014.

"SmartPIM and SmartPACK Self-acting PressFIT assembly," published online at least as early as Dec. 4, 2014 by Infineon Technologies AG, available online at http://www.infineon.com/dgdl/Infineon-SmartPIM and SmartPACK-PB-V4.0-en.pdf?fileId=db3a304320d39d5901211f14fcc46545, last visited Dec. 4, 2014.

"EconoPACK 4 IGBT Modules," published online at least as early as Dec. 4, 2014 by Infineon Technologies AG, available online at http://www.infineon.com/cms/en/product/promopages/econopack-4/, last visited Dec. 4, 2014.

"EconoDUAL 3 650V/1200V/1700V 600A—best in class," published online at least as early as Dec. 4, 2014 by Infineon Technologies AG, available online at http://www.infineon.com/cms/en/product/promopages/econodual3/, last visited Dec. 4, 2014.

"Reliability of PressFIT Connections," Thilo Stolze, Markus Thoben, Michael Koch, and Robert Severin, published online at least as early as Dec. 4, 2014 by Infineon Technologies AG, available online at https://www.btipnow.com/library/white_papers/Reliability%20of%20PressFIT%20Connections.pdf, last visited Dec. 4, 2014.

"Innovative Module Features for Advanced Inverter Designs," published online at least as early as Dec. 4, 2014 by sabellenhiitte Heusler GmbH Co. KG, available online at http://www.isotekcorp.com/sites/default/files/sites/default/files/pdfs/BodosPower_BVR%20Press%20Fit%20Module%20-%20Siemens%20IGBT.pdf, last visited Dec. 4, 2014.

"Fuji IGBT Module Mounting instruction," published online at least as early as Dec. 4, 2014 by Fuji Electric Co., Ltd., available online at http://www.fujielectric.com/products/semiconductor/technical/mounting/box/doc/MT_IGBT/MT_IGBT_E_a.pdf, last visited Dec. 4, 2014.

"Infineon IGBT Modules High-Power Semiconductors for Industrial Drives, Renewable Energy Systems, Power Supply Systems and Transportation," published online at least as early as Dec. 4, 2014 by Infineon Technologies AG, available online at http://www.ebv.com/fileadmin/design_solutions/php/download.php?path=fileadmin%2Fproducts% 2FPress_Print%2FBrochures%2FProduct_Brochures%2FInfineon_IGBT_Modules.pdf, last visited Dec. 4, 2014.

"Vincotech's Compliant Pin: Advantages of Vincotech's Power Modules with Press-fit Technology," published online at east as early as Dec. 5, 2014 by Vincotech GmbH, available online at http://www.vincotech.com/fileadmin/downloads/power/Application-Notes/AN_2010-10_001-v04_Press-fit-Application%20Note.pdf, last visited Dec. 5, 2014.

"Pressing home the advantages: the Press-Fit pin for solder-less assembly" (PDF article), published online at least as early as Dec. 5, 2014 by Vincotech GmbH, available online at http://www.vincotech.com/fileadmin/user_upload/articles/press_Fit_pin/Press-fit%20Technology%20Article.pdf, last visited Dec. 5, 2014.

"Pressing home the advantages: the Press-Fit pin for solder-less assembly" (website article), published online at least as early as Dec. 5, 2014 by Vincotech GmbH, available online at http://www.vincotech.com/en/support/technical-papers/module-mechanics-and-packaging/the-press-fit-pin.html, last visited Dec. 5, 2014.

Vincotech Press Release about Press-Fit Connecting Technology, published online Mar. 1, 2012 by Vincotech GmbH, available online at http://www.vincotech.com/en/news/pressreleases/product-news/2012/press-fit-video-announcement.html, video available online at http://www.vincotech.com/en/news/videos/videopages/film-press-fit-technology.html and https://www.youtube.com/watch?v=f1WpQGhR_MA&hd=1, last visited Dec. 5, 2014.

Vincotech Newsletter: New flowPIM0 and flowPIM1 modules now available with Press-fit pins, published online by Vincotech GmbH at least as early as Dec. 5, 2014, available online at http://web.inxmail.com/vincotech/html_mail.jsp?parms=1604+karina.seifert%40vincotech.com+6+qi00000d00000vxl, last visited Dec. 5, 2014.

"Vincotech Releases the flowPIM Power Module Family with Press-Fit Pins," published online Feb. 16, 2011 by Thomson Reuters, available online at http://www.reuters.com/article/2011/02/16/idUS209916+16-Feb. 2011+BW20110216, last visited Dec. 5, 2014.

"Semitop Press-Fit—The Alternative to Solder Mounting" (website article), published online at least as early as Dec. 5, 2014 by Semikron International GmbH, available online at http://www.semikron.com/products/new-products/semitop-press-fit.html, last visited Dec. 5, 2014.

"The Alternative to Solder Mounting: Semitop Press-Fit" (PDF article), published online at least as early as Dec. 5, 2014 by

(56) References Cited

OTHER PUBLICATIONS

Semikron International GmbH, available online at http://www.semikron.com/dl/service-support/downloads/download/semikron-flyer-semitop-press-fit-2014-04-08, last visited Dec. 5, 2014.
"Skyper 12 PF" (online article), published online at least as early as Dec. 5, 2014 by Semikron International GmbH, available online at http://www.semikron.com/products/new-products/skyper-12-press-fit.html, last visited Dec. 5, 2014.
"Robust IGBT Driver for Press-Fit Mounting," published online at least as early as Dec. 5, 2014 by Semikron International GmbH, available online at http://www.semikron.com/dl/service-support/downloads/download/semikron-flyer-skyper-2014-04-08, last visited Dec. 5, 2014.
"Semitop Press-Fit—the easy alternative solution to solder mounting" (online press release), published online at least as early as Dec. 5, 2014, available online at http://www.semikron.com/about-semikron/news-press/detail/semitop-press-fit-the-easy-alternative-solution-to-solder-mounting.html, last visited Dec. 5, 2014.
"Press-Fit variants added to power module family," published online Sep. 10, 2014 by Engineer Live, available online at http://www.engineerlive.com/content/press-fit-variants-added-power-module-family, last visited Dec. 5, 2014.

* cited by examiner

PRESS-FIT PIN FOR SEMICONDUCTOR PACKAGES AND RELATED METHODS

CROSS REFERENCE TO RELATED APPLICATIONS

This application is a continuation application of the earlier U.S. Utility patent application to Chew et al., entitled, "Press-Fit Pin for Semiconductor Packages and Related Methods," application Ser. No. 15/392,011, filed Dec. 28, 2016, now pending; which was a divisional application of the earlier U.S. Utility patent application to Chew entitled "Press-Fit Pin for Semiconductor Packages and Related Methods," application Ser. No. 14/662,591, filed Mar. 19, 2015, issued as U.S. Pat. No. 9,570,832 on Feb. 14, 2017, the disclosures of each of which are hereby incorporated entirely herein by reference.

BACKGROUND

1. Technical Field

Aspects of this document relate generally to semiconductor device packaging and installation of semiconductor device packages to a printed circuit board (PCB) (motherboard) and/or to other elements.

2. Background Art

Semiconductor device packages (packages) often include elements to mount or otherwise couple the package to a printed circuit board (PCB) (motherboard) or to other elements. Such mounting elements sometimes include pins that are configured to be press-fit into pin receivers of a PCB/motherboard or other element. Press-fit pins on such semiconductor device packages generally do not require soldering to couple the pins and thus the package to the PCB/motherboard or other element. The pins are generally configured to electrically couple components of the package with external components of the motherboard/PCB or other external elements.

SUMMARY

Implementations of press-fit pins for semiconductor packages may include: a shaft terminating in a head, and; a pair of arms extending away from a center of the head, each arm having a curved shape, the pair of arms together forming an s-shape; wherein a length of the s-shape is longer than a diameter of the shaft; and wherein an outer extremity of each arm has a contact surface configured to electrically couple to and form a friction fit with a pin receiver.

Implementations of press-fit pins for semiconductor packages may include one, all, or any of the following:

The press-fit pin may have only two surfaces configured to contact an inner sidewall of the pin receiver.

The press-fit pin may be configured to contact an inner sidewall of the pin receiver at only two locations.

The shaft may include a cylinder.

The s-shape formed by the pair of arms may be visible from a view facing a top of the press-fit pin along a direction parallel with the longest length of the shaft.

The head may include a through-hole extending therethrough.

The through-hole may be accessible through two openings in a side surface of the head, each opening having a stadium shape.

The s-shape may be rotationally symmetric about a center of the shaft.

The head may form a spiral shape.

Implementations of press-fit pins for semiconductor packages may include: a shaft terminating in a head, and; a pair of arms extending away from a center of the head, each arm having a curved shape, the pair of arms together forming an s-shape; wherein an outer extremity of each arm has a contact surface configured to electrically couple to and form a friction fit with a pin receiver; wherein a length of the s-shape is longer than a diameter of the shaft; wherein the press-fit pin has only two surfaces configured to contact an inner sidewall of the pin receiver; and wherein the s-shape is substantially rotationally symmetric about a center of the shaft.

Implementations of press-fit pins for semiconductor packages may include one, all, or any of the following:

The press-fit pin may be configured to contact the inner sidewall of the pin receiver at only two locations.

The shaft may include a cylinder.

The head may include a through-hole extending therethrough.

The through-hole may be accessible through two openings in a side surface of the head, each opening having a stadium shape.

Implementations of a method of forming a press-fit pin for a semiconductor package may include: compressing an upper portion of a shaft, along a direction perpendicular to a longest length of the shaft, to deform the upper portion into a flattened section; bending two opposing sides of the flattened section to form two angled arms, each angled arm being angled relative to a central portion of the flattened section, and; curving each of the angled arms into a c-shape to form two curved arms so that the curved arms together form an s-shape, forming a head of the press-fit pin.

Implementations of a method of forming a press-fit pin for a semiconductor package may include one, all, or any of the following:

The shaft may include a cylinder terminating in a truncated cone, and the upper portion of the shaft may include the truncated cone and a portion of the cylinder, prior to deforming the upper portion into a flattened section.

The method may include forming a through-hole in the head.

Compressing the upper portion of the shaft into the flattened section may include pressing the upper portion of the shaft with a press having two opposing flat members.

Bending the two opposing sides of the flattened section to form the two angled arms may include pressing the flattened section with a press having two opposing angled members, the two opposing angled members having complementary angled faces relative to one another.

Curving each of the angled arms into a c-shape may include pressing the angled arms with a press having two opposing curved members, each of the opposing curved members having a concave face facing the angled arms.

Implementations of press-fit pins for a semiconductor package may include: a shaft terminating in a head, and; a plurality of arms extending away from a center of the head, each arm having a curved shape, the plurality of arms forming a shape that is rotationally symmetric about an axis of the shaft; wherein a length of the shape is longer than a diameter of the shaft; and wherein an outer extremity of each arm includes a contact surface configured to electrically couple to and form a friction fit with a pin receiver.

Implementations of press-fit pins may include one, all, or any of the following:

Each arm of the press-fit pin may form a c-shape.

The press-fit pin may have only three arms extending away from the center of the head.

The press-fit pin may have only four arms extending away from the center of the head.

The four arms may form two s-shapes that are rotationally symmetric about the axis of the shaft.

The press-fit pin may have at least four arms extending away from the center of the head.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended press-fit pins for semiconductor packages and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such press-fit pins for semiconductor packages and related methods, and implementing components and methods, consistent with the intended operation and methods.

Figure 1:
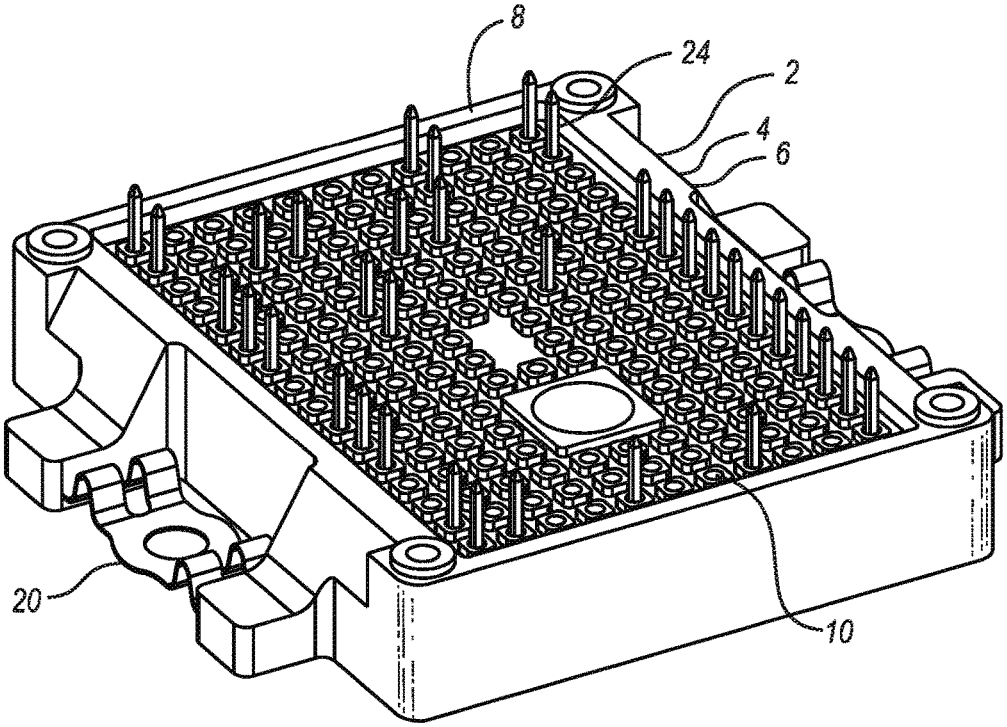
FIG. 1 is a top-perspective view of an implementation of a power module which includes implementations of press-fit pins.
Figure 2:
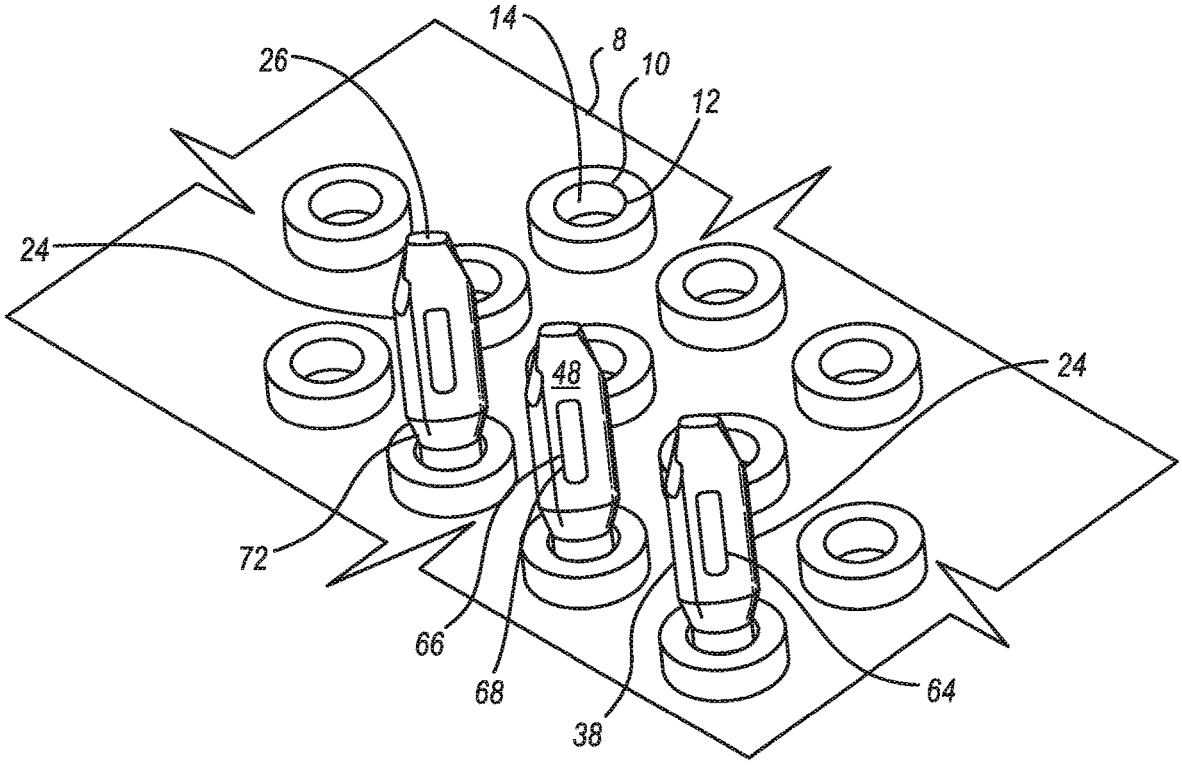
FIG. 2 is a top-perspective close-up view of some of the press-fit pins and a portion of a housing of the power module of FIG. 1.

Referring now to FIGS. 1-2, in various implementations a semiconductor package (package) 2 includes one or more press-fit pins (pins) 24 extending through openings 10 in a housing 8. The housing 8 houses, within a cavity, one or more semiconductor die coupled to a substrate, with each pin 24 coupled to a substrate within the housing. The one or more die may include one or more power semiconductor die, such as one or more power metal-oxide-semiconductor field-effect transistors (power MOSFETs), one or more insulated-gate bipolar transistors (IGBTs), and the like. The package 2 may accordingly include a power module 4, such as a power integrated module (PIM) 6 or an integrated power module (IPM). The one or more die may be coupled to a substrate, which in particular implementations may be a power electronic substrate. The substrate or power electronic substrate may in turn be coupled to a baseplate, which in turn may be coupled to a heat sink or the like, or the baseplate in some implementations may be omitted and the substrate may be directly coupled to a heat sink or the like. The power module 4 may be used for power applications in various settings such as, by non-limiting example, a vehicle such as an automobile (electric or gas), a wind turbine, a solar power panel, a power plant, an industrial machine, and so forth.

The power electronic substrate may include, by non-limiting example, a direct bonded copper (DBC) substrate, an active metal brazed (AMB) substrate, an insulated metal substrate (IMS), a ceramic substrate, and the like. In implementations in which the package 2 is not a power module, a different type of substrate could be used. As indicated above, each pin 24 is coupled to the substrate. For example, the substrate may include connection traces thereon—some or all of which couple with electrical contacts of the one or more die either directly (such as through flip chip bumps) or indirectly through bondwires, conductive clips, and the like—and one or more of the pins 24 may accordingly electrically couple with the electrical contacts of the one or more die by being electrically coupled to the connection traces. Each pin 24 may, for example, be soldered to one of the connection traces, or coupled thereto using a conductive adhesive, and/or other connection mechanisms may be used. Some substrates may include lower pin couplers, such as hollow elements, each of which is coupled to one of the connection traces and each of which is configured to receive a lower end of one of the pins 24 either through a friction fit, an adhesive, soldering, and the like. Each lower pin coupler could be attached to one of the connection traces using solder, a conductive adhesive, and the like.

The pins 24 once coupled to the substrate are configured to extend upwards such as to exit the openings 10 in housing 8 when the housing 8 is lowered towards the substrate. The housing 8 may be attached to the substrate and/or baseplate or otherwise coupled thereto, such as using screws, a friction fit, an adhesive, soldering, and the like. The pins 24 then, extending upwards through the openings 10, are used to couple the one or more die to one or more power sources, one or more electrical grounds, one or more electrical components external to the package 2, and the like by coupling the pins to a motherboard, printed circuit board (PCB) or the like. As indicated previously, each pin 24 may be coupled to one or more of the die using a network of connection traces on a surface of the substrate. A bottom surface of the substrate, opposite the surface where the pins attach or otherwise couple thereto, may in implementations be coupled to one or more heat sinks, heat spreaders, heat pipes, or the like, as indicated above to draw heat away from the one or more die during operation—or a baseplate may be used between the substrate and heat spreader/sink/pipe etc. In the implementation shown couplers 20 may be used for coupling the substrate to such heat extraction elements and/or to couple the bottom of the substrate to electrical ground. The baseplate in implementations, if used, is formed of one or more metals such as copper, nickel, molybdenum, tungsten, and/or other metals.

Figure 10:
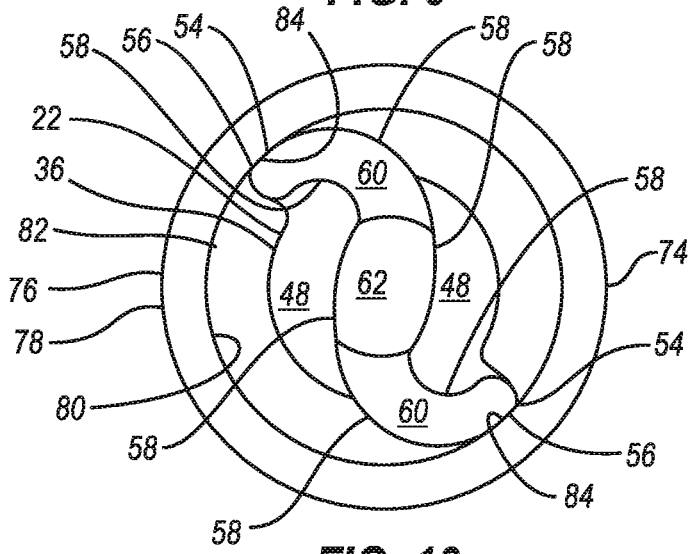
FIG. 10 is a top view of the press-fit pin of FIG. 3 coupled with a pin receiver.

The press-fit pins 24 are used to mechanically and electrically couple the semiconductor package 2 to a printed circuit board (PCB), a motherboard, or some other panel or device. Referring to FIG. 10, this is accomplished using openings or through-holes in the PCB, motherboard, panel or other element which form pin receivers 74 which are configured to form a friction fit with the heads 38 of the pins 24. The pin receivers 74 are generally therefore conductive to electrically couple a pin 24 to some electrical component, though some pin receivers may be electrically grounded or otherwise not conductive, depending upon the particular design. Similarly, while the pins 24 are generally electrically coupled to the one or more die through connection traces in the substrate, one or more of the pins 24 may be isolated from the die and other electrical components of package 2 and may simply be used for mechanical/physical connection to the PCB, motherboard or other element. Because the press-fit pins 24 are configured to form a friction fit with the pin receivers 74, the pins 24 can therefore be coupled to the PCB, motherboard, or other elements without the use of solder, a conductive adhesive, or other attachment materials.

In various implementations, an encapsulation compound may be used to encapsulate elements of the package 2 after the pins 24 have been placed thereon. By non-limiting example, a silicone potting compound could be deposited onto a top of the substrate through a large opening shown in the upper side of the housing 8 in FIG. 1 (the large circle surrounded by openings 10). In other implementations another encapsulation compound and/or method may be used, such as an epoxy resin applied using resin transfer molding or some other mechanism, and the like. The encapsulation compound encapsulates each of the one or more die, at least a portion of an upper side of the substrate, and at least a portion of each pin 24, but as seen in FIG. 1 the encapsulation compound does not extend outside the housing 8, but is retained therein.

Figure 8:
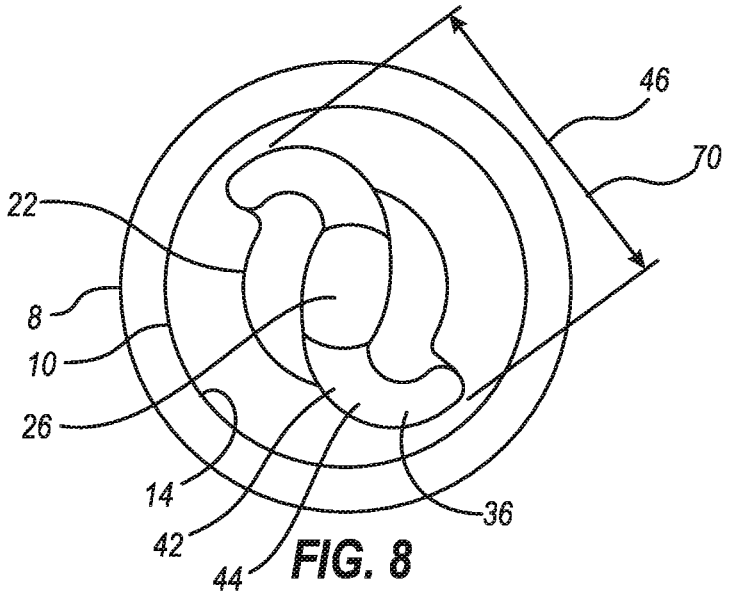
FIG. 8 is a top view of the press-fit pin of FIG. 3 and a circular opening of a housing.
Figure 9:
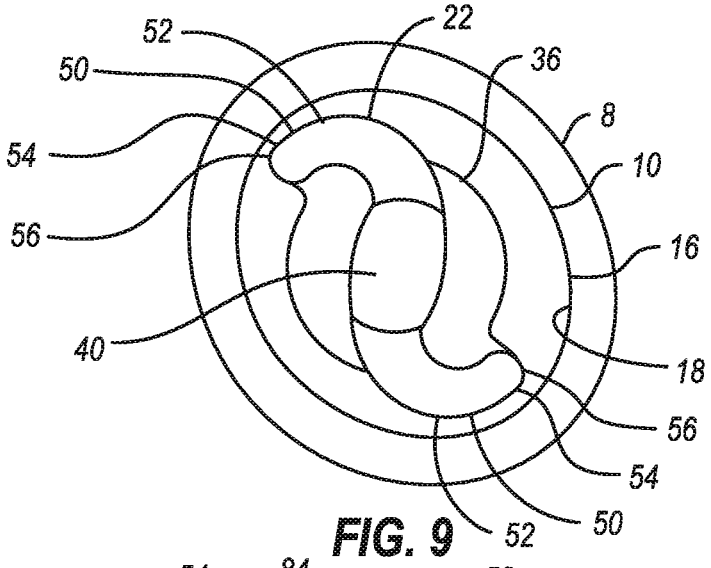
FIG. 9 is a top view of the press-fit pin of FIG. 3 and an elliptical opening of a housing.

Referring to FIGS. 1 and 2, in implementations the housing 8 may have an array of openings 10 but in implementations not every opening 10 will have a pin 24 extending therethrough. Each opening 10 is generally sized so that the head 38 of the pin 24 may easily pass therethrough. In FIG. 2 the openings 10 may appear smaller in diameter than the heads 38 but this is due to the elements not being drawn to scale in order to emphasize details of the pins—a better reflection of the actual relative sizes of the pin and opening 10 in most implementations is given in FIGS. 8-9. The openings 10 in some implementations could be designed so that they have a smaller diameter than the heads 38, but in most implementations will be sized to have a larger diameter than the heads 38 so that the heads 38 can easily pass therethrough when the housing 8 is lowered to cover the one or more die and be coupled to the substrate. Referring to FIG. 8, in some implementations the openings 10 are circular openings 12 having an inner diameter defined by an inner sidewall 14 that is larger than a greatest diameter 70 of the pin 22, 24. Referring to FIG. 9, in other implementations the openings 10 are elliptical openings 16 having a greatest inner diameter defined by inner sidewall 18 that is greater than a greatest diameter of pin 22, 24.

In the implementation of the package 2 shown in FIG. 1 the pins extend through the openings 10 of the housing 8 in a variety of places including some along an outer perimeter of the housing 8, some closer to a center of the housing 8, and so forth. In other implementations of packages the pins may extend through the housing only along an outer perimeter of openings 10, and in some such implementations the pins may have horizontal portions to contact a substrate whose outer perimeter is smaller than the outer perimeter of openings 10 through which pins extend.

Figure 6:
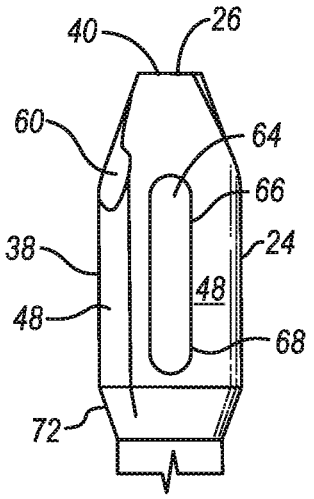
FIG. 6 is a side view of another implementation of a press-fit pin.
Figure 7:
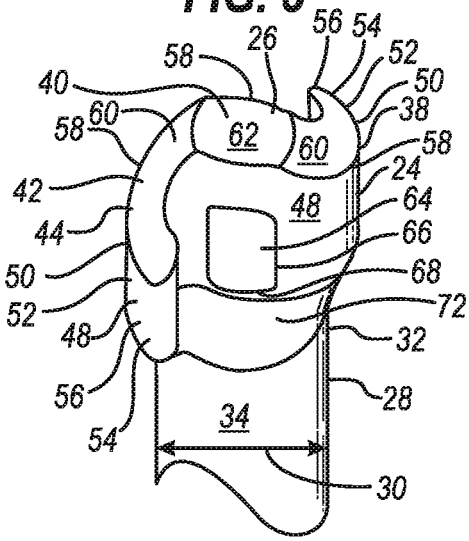
FIG. 7 is a top-perspective view of the press-fit pin of FIG. 6 having the same rotation along an axis defined by a longest length of the press-fit pin as in FIG. 6.

As can be seen in FIGS. 2, 6 and 7, each pin 24 includes a through-hole 64 passing fully through the head 38. Each pin 24 has a top 26 at a flat upper surface 62. Two downwardly sloping surfaces 60 are adjacent to the flat upper surface 62. The flat upper surface 62 and downwardly sloping surfaces 60 are bordered by a continuous edge 58. The continuous edge 58 separates each of the downwardly sloping surfaces 60 and the flat upper surface 62 from a side surface 48, which forms a single continuous surface all the way around a side of the head 38. The side surface 48 is coupled to a lower section 72 which resembles an upside down conical frustum or, in other words, an upside down truncated cone, coupling the head 38 with a shaft 28. The shaft in various implementations forms a cylinder 32, though in other implementations it could be formed of a different shape, such as a cuboid having a cross section perpendicular to a longest length of the shaft 28 that has a square or a rectangle shape, or a triangular prism having a cross section in this same direction that is a triangle, or may have a cross section that is any other regular or irregular closed shape.

Pin 24 has a pair of arms 50 that extend outwards from a center 40 of the head 38. Each arm 50 has a curved shape 52 which, in implementations, forms a c-shape, and together the arms 50 form an s-shape 44. The head 38 therefore has a spiral shape 42. The s-shape 44 may resemble a forward letter "s" or a backwards letter "s." In the implementations shown in the drawings the s-shape 44 resembles a backwards letter "s" if one views the pin looking downwards at the top 26. If one views the pin looking upwards from a bottom of the shaft 28, the s-shape 44 resembles a forward letter "s." Referring to FIG. 10, each arm 50 has an outer extremity 54 whereon a contact surface 56 is located. The contact surface 56 contacts an inner sidewall 80 of the pin receiver 74 when the pin is inserted into the pin receiver and thereby mechanically and electrically couples to the pin receiver 74. As seen in FIG. 10, in implementations a portion of the pin receiver 74 has a circular shape 76, and in implementations an opening wherein the pin 24 enters the pin receiver 74 has a circular shape. The pin receiver 74 in implementations includes a cylinder 78 with an inner sidewall 80 forming a cylindrical cavity 82. The pin 24 in implementations contacts the inner sidewall 80 of the pin receiver 74 at only two locations 84. The two locations 84 in implementations are on opposite sides of the inner sidewall 80. The two locations in FIG. 10 both lie along a line that is perpendicular to a longest length of the cylindrical cavity 82, and perpendicular to a longest length of the shaft 28, and which bisects the pin receiver 74 into two equal halves.

Referring back to FIGS. 6-7, the through-hole 64 passes completely through the head 38 from one portion of the side surface 48 to another portion of the side surface 48 on an opposite side of the head 38. The through-hole 64 is accessible by a pair of openings 66. The openings 66 shown in the drawings each have a stadium shape 68, though in other implementations the openings 66 may have other shapes such as a circle, an oval, an ellipse, a football shape, and the like. The stadium shape 68, however, may be useful to allow the through-hole 64 to have a relatively long length parallel, or substantially parallel, with a longest length of the pin, without having sharp edges, which sharp edges could be locations where cracks are more likely to initiate and/or propagate in the pin 24. As seen in FIG. 6, the through-hole 64 has a constant cross-section through the pin, the constant cross-section being in the shape of a stadium similar to the openings 66 all the way through the pin. In other implementations the through-hole 64 need not have a constant cross-section therethrough, and could be thinner or wider within the head 38 than it is at the openings 66.

The through-hole 64 allows the pin 24 to compress and/or deform when pin 24 is inserted into the pin receiver 74. Such deformation may include only reversible elastic deformation such that the pin 24 could be removed and inserted into another pin receiver 74 or the same pin receiver 74 multiple ties without degrading the quality of the friction fit therebetween, or the deformation could include elastic and plastic deformation such that if the pin 24 is removed from pin receiver 74 it will retain its compressed shape to some extent. The deformation, elastic and/or plastic, may contribute to the ability to insert the pin 24 into the pin receiver 74 without plastically deforming and/or damaging the pin receiver 74 or the PCB/motherboard or other element in which the pin receiver 74 resides.

Referring to FIGS. 7, 8 and 10, in various implementations, the s-shape 44 has a length 46 and the shaft 28 has a diameter 30. The magnitude of length 46 is greater than the magnitude of diameter 30. In particular implementations, length 46 is a greatest diameter 70 of the head 38 and a greatest diameter of the s-shape 44. As shown in FIGS. 8-9, the length 46 and/or greatest diameter 70 are smaller than a greatest inner diameter of openings 10 so that the head 38 may pass through opening 10 without contacting the inner sidewalls 14 or 18 of the openings, as described above. As shown in the drawings, the length 46 may be measured along a direction that is perpendicular to a longest length of the shaft 28 and, accordingly, a greatest diameter 70 of the head 38 measured perpendicular to a longest length of the shaft 28 may be greater than a greatest diameter of the shaft 28 measured perpendicular to the longest length of the shaft. Shaft 28 also has a side surface 34.

Figure 3:
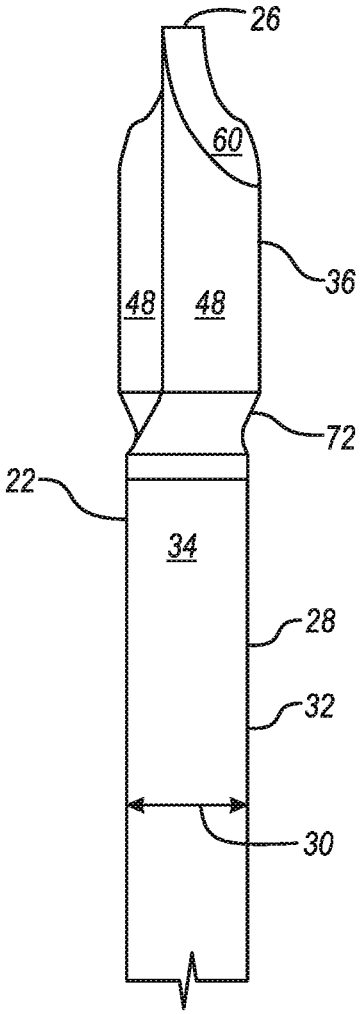
FIG. 3 is a side view of an implementation of a press-fit pin.
Figure 4:
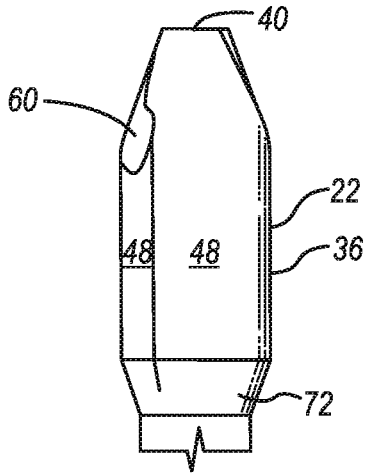
FIG. 4 is a side view of the press-fit pin of FIG. 3 with the press-fit pin rotated ninety degrees about an axis defined by a longest length of the press-fit pin.
Figure 5:
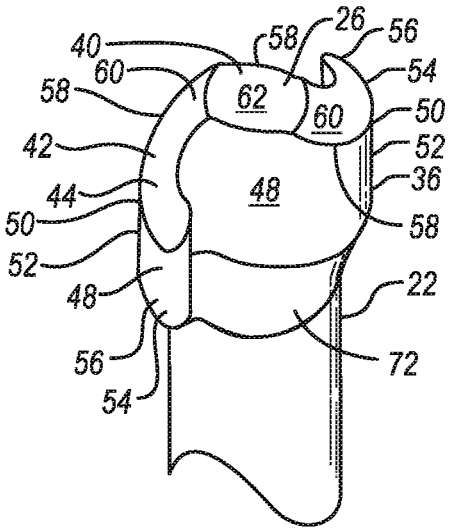
FIG. 5 is a top-perspective view of the press-fit pin of FIG. 3 with the press-fit pin having the same rotation along an axis defined by a longest length of the press-fit pin as in FIG. 4.

Referring now to FIGS. 3-5, in implementations a press-fit pin (pin) 22 is identical to press-fit pin 24 except that the head 36 of pin 22 lacks the through-hole 64 and openings 66. Pin 22 accordingly, if formed out of the same material as pin 24, may not deform elastically and or plastically as much as pin 24 when being inserted into a pin receiver 74. Apart from these differences, pin 22 is identical in dimensions, faces, arms, and all other features to pin 24. Accordingly, wherever throughout this document either pin 22 or 24 is referred to, except inasmuch as it relates to through-hole 64 or openings 66, the same description may apply equally to the other pin 24 or 22. FIG. 3 is a side view of pin 22 and FIG. 4 is another side view of pin 22 with the pin 22 rotated ninety degrees along an axis parallel with a longest length of the shaft 28. Pin 24 shown in FIG. 6, when rotated ninety degrees along an axis defined by a longest length of the pin 24, has the same appearance as the appearance of pin 22 shown in FIG. 3.

Figure 11:
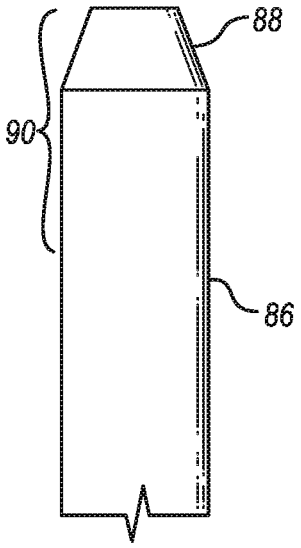
FIG. 11 is a side view of a shaft used in the formation of an implementation of a press-fit pin.
Figure 13:
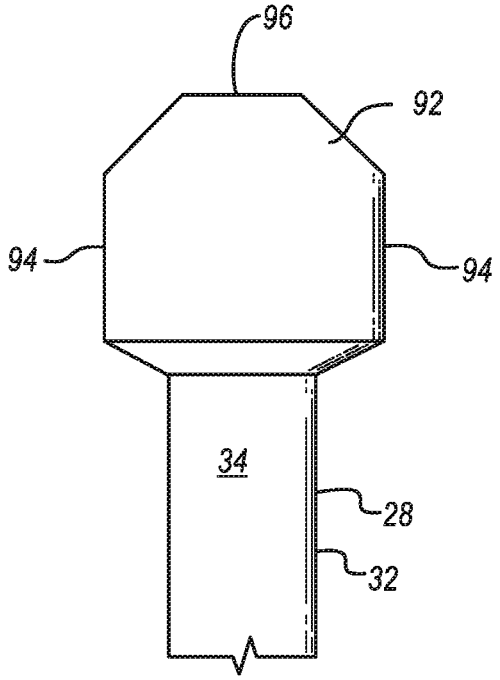
FIG. 13 is a side view of the shaft of FIG. 11 after deformation using the press of FIG. 12.
Figure 12:
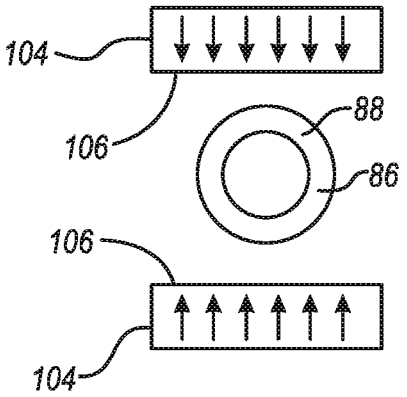
FIG. 12 is a top view of the shaft of FIG. 11 and a press used to deform the shaft.

Referring to FIGS. 11-18, an implementation of a method of forming a pin 22 is shown. Referring to FIG. 11, a shaft 86 is provided which includes an elongated cylinder terminating in a truncated cone 88. This shape could be provided by starting, by non-limiting example, with cylindrical metal wire or cylindrical metal rods which are cut into specified lengths (the length of shaft 86) and then machined at an end of each length such as with a lathe, grinder or other machining tool to remove some material at that end to form the truncated cone.

In implementations in which cylindrical metal wire is used, the diameter of the wire perpendicular to its longest length may originally have a diameter greater than shaft 86 and may be reduced so that it has the same diameter as shaft 86 such as by a stretching process—such processes are known in the art and can involve, by non-limiting example, winding the wire off of a first spool while winding the wire onto a second spool under conditions in which the rotation of the first spool is resisted in some manner so that the wire undergoes tension during the winding process sufficient to plastically deform the wire, thereby stretching it to increase its longest length and correspondingly decrease its diameter perpendicular to its longest length, drawing the wire through a die, and other methods of substantially uniformly reducing the diameter of a wire. Such stretching processes may be used to decrease the diameter of the wire so that it equals the diameter of shaft 86 in a single pass or may be used to decrease the diameter incrementally using several passes between two or more spools.

The methods described herein for forming pins 22, 24 may include the methods of reducing the diameter of stock metal wire or metal rods, cutting the metal wire or metal rods into sections having a longest length that is the length of shaft 86, and/or forming the truncated cone at the end of the shaft 86 through a machining process.

Presses 104 include two flat members 106 which oppose one another and these are pressed against an upper portion 90 of the shaft 86 which includes a portion of the cylinder and the entire truncated cone 88. This pressing operation is done by moving the presses 104 towards one another in the direction shown by the arrows on the presses 104 in FIG. 12. In some implementations both presses 104 move in this operation and in others only one press 104 moves while the other is stationary. When this operation is performed the upper portion 90 is flattened resulting in the configuration shown in FIG. 13. A flattened section 92 is thus formed which includes a central portion 96, having a top that corresponds with a top of what used to be the truncated cone 88, and two sides 94 which oppose one another. The flattening operation by the presses 104 leaves a portion of the shaft 86 undeformed and this undeformed portion forms the shaft 28 of the final pin 22/24 which has the shape of a cylinder 32 and which has side surface 34.

There is also a portion below the flattened section 92 which resembles the lower section 72 of finished pin 22/24, and this portion will be shaped into the upside-down conical frustum or, in other words, the upside down truncated cone shape of lower section 72 as a result of the deformation processes described herein.

Figure 14:
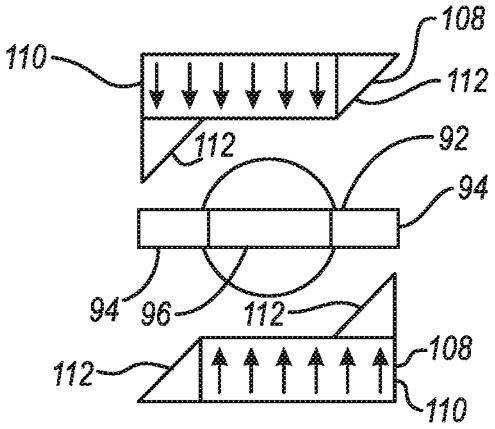
FIG. 14 is a top view of the shaft of FIG. 13 and a press used to further deform the shaft.
Figure 15:
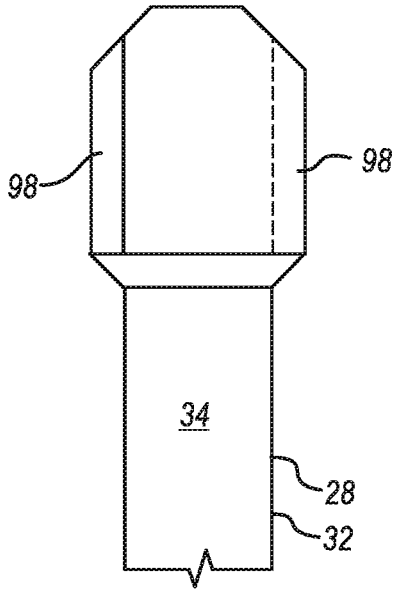
FIG. 15 is a side view of the shaft of FIG. 13 after deformation using the press of FIG. 14.
Figure 17:
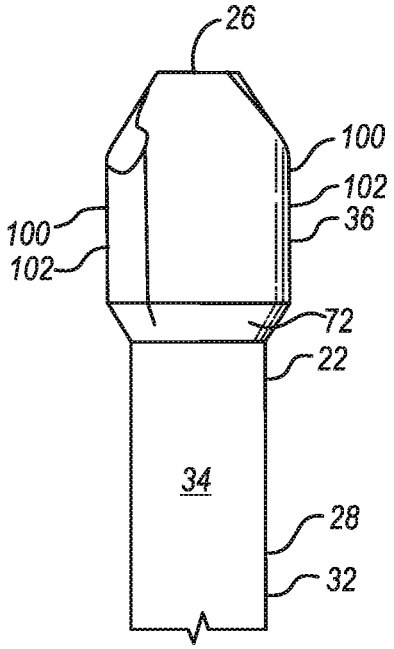
FIG. 17 is a side view of the shaft of FIG. 15 after deformation using the press of FIG. 16, which shaft is formed into the press-fit pin of FIGS. 3-5.

Referring to FIG. 14, presses 108 include opposing angled members 110 having complementary angled faces 112. Presses 108 are pressed against the shaft in the directions shown by the arrows on the presses 108 in FIG. 14—though as described with respect to presses 104, presses 108 may each move or one may be static while the other moves during this process. The complementary angled faces 112 press against the opposing sides 94 of the flattened section 92 to bend the sides 94 into angled arms 98, as shown in FIGS. 15-16.

Figure 16:
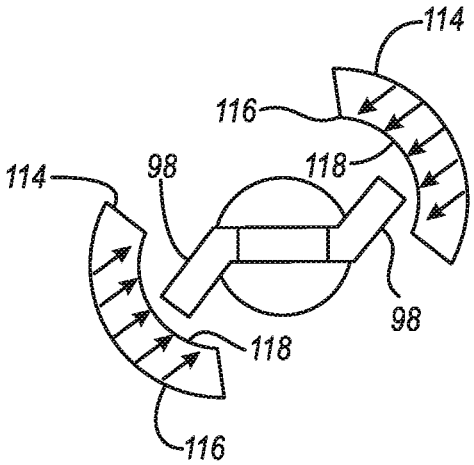
FIG. 16 is a top view of the shaft of FIG. 15 and a press used to further deform the shaft.
Figure 18:
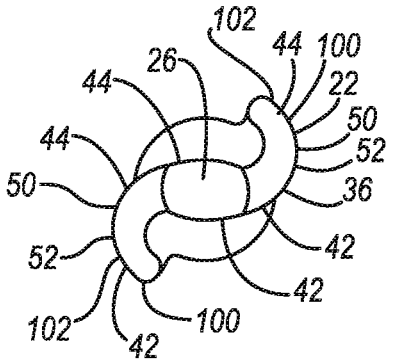
FIG. 18 is a top view of the shaft of FIG. 17.

Referring to FIG. 16, presses 114 include curved members 116 each of which has a concave face 118 facing the shaft. Presses 114 are moved relative to one another towards the shaft, in the direction shown on the arrows on the presses 114 in FIG. 16, though as indicated with other presses this movement may involve both presses 114 moving or it may involve only one press 114 moving while the other is stationary. The concave faces 118 of the curved members 116 press against the angled arms 98 to deform the angled arms 98 into curved arms 102, each of which has a c-shape 100. The c-shapes 100 of the curved arms 102 together form the s-shape 44 described herein. Thus the side view of FIG. 17 and the top view of FIG. 18 show a finished pin 22 formed by the deformation processes described herein.

Pin 24 may be formed by similar process but by also adding a process of forming the through-hole 64 through punching, stamping, drilling, and the like. In other implementations the shaft 86 may be originally formed with the through-hole 64 therein, such as by casting a metal rod with through-holes therein which are then cut into sections and formed into the pins.

In implementations the pins 22/24 may be formed of any thermally and/or electrically conductive metal or metal alloy. In implementations the pins are formed of a copper alloy. The deformation of the pin during insertion into the pin receiver in implementations results in a compressive residual stress in the pin and/or the pin receiver which holds the pin in the friction fit relative to the pin receiver. In implementations the pins are pressed into the pin receivers using pressure and heat is also used to assist in making the pins/pin receivers more ductile and/or to assist in some atomic fusion/bonding between the pin and pin receiver to form a weld therebetween. In some implementations, for instance, the heads of the pins could be heated prior to the insertion process. In other implementations no heat is used or heat is used but is insufficient to form a weld between the pin and pin receiver. In such implementations the pin may be removed from the pin receiver and reinserted into the same pin receiver or another pin receiver as desired.

Specific dimensions of the pins 22/24 may vary according to the application.

Although the bottommost portion of the pin 22, 24 is not shown in any of the drawings, in implementations the shaft 28 may continue straight downwards and terminate in an end that is the same width as the portions of the shaft 28 shown in the drawings, and may have a flat bottom having the same cross section as the remainder of the shaft along a direction perpendicular with a longest length of the shaft. In other implementations the shaft 28 may have a mounting portion at its bottom end which is a flat base having a diameter measured perpendicular with a longest length of the shaft that is greater than diameter 30. The mounting portion or base may have any shape, such as a circle, a square, a triangle, any polygon, and any other regular or irregular closed shape. In some implementations the shaft 28 may include a stress relief portion which includes one or more bends in the shaft, such as a c-shaped bend or an s-shaped bend. These bends may allow increased elastic deformation of the shaft along its longest length to decrease stresses the pin imparts to the substrate, the pin receivers, the connection traces and/or other elements of the package 2 during thermal stresses, mounting stresses while pressing the pins into pin receivers, and the like.

The pins 22/24 may be installed on a PCB/motherboard or the like, to install package 2 thereon, by pressing the motherboard/PCB or other item and the pins 22/24 together so that each pin enters a pin receiver 74. This may be done such as with a pressure plate pressing down on the package 2 and/or on the PCB/motherboard in a manner that presses them towards each other while each pin is aligned with a corresponding pin receiver. In some cases the installation may be done with manual pressure alone. If it is desirable to remove the package 2 from the motherboard/PCB or other device, such as in the case of a package 2 that needs repair, replacement or maintenance, the package 2 may, in some implementations, be decoupled from the motherboard, PCB or other device by pressing on the tops 26 of the pins so that the wider portion of each pin, which corresponds with the contact surfaces 56, exits the cylindrical cavity 82 or otherwise positions itself lower in cylindrical cavity 82 so that there is less friction between the contact surfaces 56 and the inner sidewall 80 so that the package 2 may be easily removed from, or even by gravity alone may be removed from, the motherboard, PCB or other item. In some implementations, the package 2 may be able to be removed from a PCB, motherboard or other item by snipping or severing a portion of each pin which extends above a side of the PCB/motherboard opposite a side of the PCB/motherboard facing the housing 8, and then manually separating the package 2 therefrom.

Figure 19:
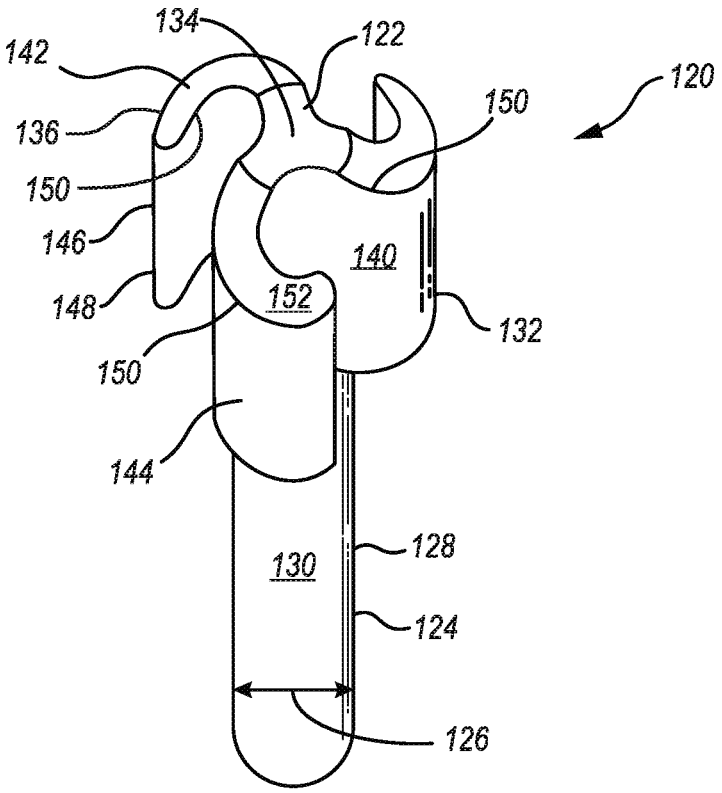
FIG. 19 is a top-perspective view of an implementation of a press-fit pin.
Figure 20:
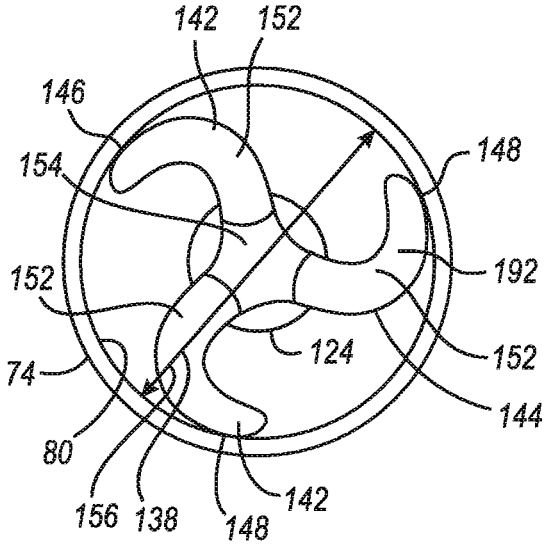
FIG. 20 is a top view of the press-fit pin of FIG. 19 coupled with a pin receiver.

Referring now to FIGS. 19-20, implementations of a press-fit pin 120 include a head 132 coupled to a shaft 124. Three arms 142 extend outwards from a center 134 of the head to form a three-armed spiral shape 136 which is rotationally symmetric about an axis of the shaft or, in other words, rotationally symmetric about the center 134. Although the arms are shown spiraling in a counter-clockwise direction, in other implementations they could be spiraling in a clockwise direction instead. Each arm has a curved shape 144 and a contact surface 148 at an outer extremity 146 of the arm is configured to contact an inner sidewall 80 of a pin receiver 74 as described with respect to other press-fit pins. There is a flat upper surface 154 at a top 122 of the press-fit pin and a downwardly sloping surface 152 defining a top side of each arm. A single continuous side surface 140 defines the sides of the arms and a single continuous edge 150 joins the downwardly sloping surfaces 152 and the flat upper surface 154 to the single continuous side surface 140.

The shaft 124 has a side surface 130 and in implementations is a cylinder 128 having a diameter 126, though in implementations other closed shapes could be used. Referring to FIG. 20, the three-armed spiral shape has a length 138 and a greatest diameter 156 perpendicular to the axis of the shaft that is greater than the diameter 126 of the shaft and that facilitates a tight fit with pin receiver 74 for a mechanical and electrical coupling thereto.

Figure 21:
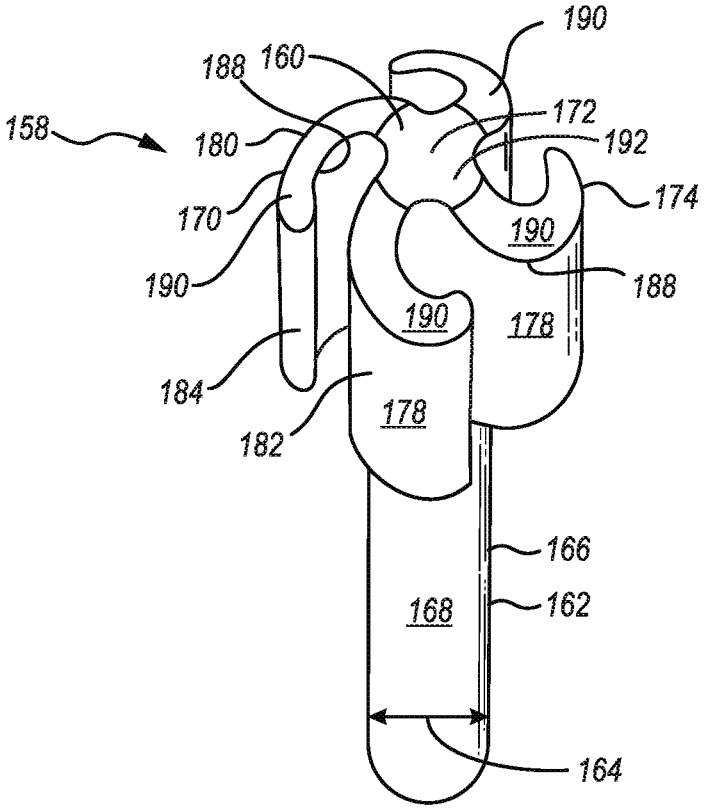
FIG. 21 is a top-perspective view of an implementation of a press-fit pin.
Figure 22:
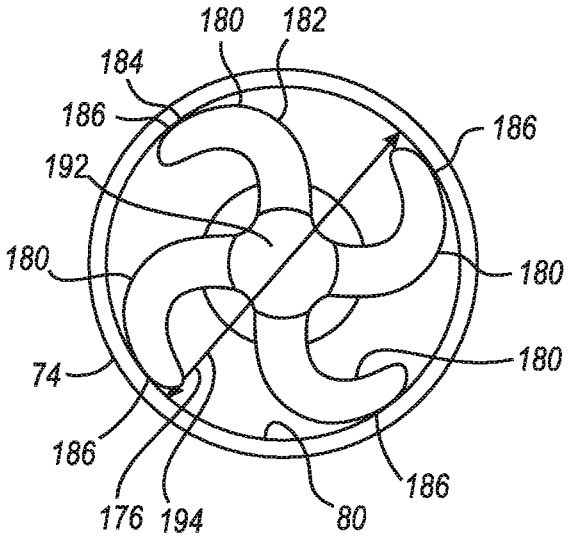
FIG. 22 is a top view of the press-fit pin of FIG. 21 coupled with a pin receiver.

Referring now to FIGS. 21-22, in implementations a press-fit pin 158 includes a head 170 coupled to a shaft 162. Four arms 180 extend outwards from a center 172 of the head to form a four-armed spiral shape 174 which is rotationally symmetric about an axis of the shaft or, in other words, rotationally symmetric about the center 172. Although the arms are shown spiraling in a counter-clockwise direction, in other implementations they could be spiraling in a clockwise direction instead. Each arm has a curved shape 182 and a contact surface 186 at an outer extremity 184 of the arm is configured to contact an inner sidewall 80 of a pin receiver 74 as described with respect to other press-fit pins. There is a flat upper surface 192 at a top 160 of the press-fit pin and a downwardly sloping surface 190 defining a top side of each arm. A single continuous side surface 178 defines the sides of the arms and a single continuous edge 188 joins the downwardly sloping surfaces 190 and the flat upper surface 192 to the single continuous side surface 178.

The shaft 162 has a side surface 168 and in implementations is a cylinder 166 having a diameter 164, though in implementations other closed shapes could be used. Referring to FIG. 22, the four-armed spiral shape has a length 176 and a greatest diameter 194 perpendicular to the axis of the shaft that is greater than the diameter 164 of the shaft and that facilitates a tight fit with pin receiver 74 for a mechanical and electrical coupling thereto.

Press-fit pins are disclosed herein that have two, three, and four arms spiraling outwards from a center of a head coupled with a shaft. It may be understood that other press-fit pins having any other number of arms may be designed, such as a press-fit pin having five, six, seven, eight, nine, ten, or more arms spiraling outwards from a center of a head coupled with a shaft, each arm having a contact surface at an outer extremity to contact an inner sidewall of a pin receiver. It may also be seen from FIGS. 19-22 that each arm forms a c-shape, and in the version shown in FIGS. 21-22 the four arms form two s-shapes that are rotationally symmetric about the axis of the shaft.

In places where the description above refers to particular implementations of press-fit pin for semiconductor packages and related methods and implementing components, sub-components, methods and sub-methods, it should be readily apparent that a number of modifications may be made without departing from the spirit thereof and that these implementations, implementing components, sub-components, methods and sub-methods may be applied to other press-fit pin for semiconductor packages and related methods.

What is claimed is:

1. A press-fit pin for a semiconductor package, comprising:

a shaft terminating in a head, the head comprising a head diameter larger than a shaft diameter of the shaft; and a plurality of arms extending away from the head, each arm comprising a curved shape configured to allow each arm to form a friction fit with a pin receiver, further comprising a through hole in the head.

2. The pin of claim 1, wherein the shaft comprises a cylinder.

3. The pin of claim 1, wherein each arm of the plurality of arms comprises a c-shape.

4. The pin of claim 1, wherein the plurality of arms contact an inner sidewall of the pin receiver at only two locations.

5. The pin of claim 1, wherein the head comprises a truncated cone.

6. The pin of claim 1, wherein the plurality of arms taper toward a top end of the head.

7. The pin of claim 1, wherein the through-hole comprises a stadium shape.

8. A press-fit pin for a semiconductor package, comprising:

a shaft terminating in a head, the head comprising a first diameter larger than a second diameter of the shaft, the head comprising an entirety of a through-hole therein; and a plurality of arms extending away from the head, each arm comprising a curved shape.

9. The pin of claim 8, wherein the shaft comprises a cylinder.

10. The pin of claim 8, wherein each arm of the plurality of arms comprises a c-shape.

11. The pin of claim 7, wherein the plurality of arms contact an inner sidewall of a pin receiver at only two locations.

12. The pin of claim 8, wherein the head comprises a truncated cone.

13. The pin of claim 8, wherein the plurality of arms taper toward a top end of the head.

14. The pin of claim 8, wherein the through-hole comprises a stadium shape.

15. A press-fit pin for a semiconductor package, comprising:

a shaft terminating in a head, the head comprising a first diameter larger than a second diameter of the shaft, the head comprising an entirety of a through-hole therein; and at least two arms extending away from the head, each arm comprising a curved shape.

16. The pin of claim 15, wherein the shaft comprises a cylinder.

17. The pin of claim 15, wherein each arm of the at least two arms comprises a c-shape.

18. The pin of claim 15, wherein the head comprises a truncated cone.

19. The pin of claim 15, wherein the at least two arms each taper toward a top end of the head.

* * * * *